US005644901A

United States Patent [19]

Tsuzuki

[11] Patent Number: 5,644,901

[45] Date of Patent: Jul. 8, 1997

[54] YARN SPOOL APPARATUS AND METHOD

[75] Inventor: Kiyohiro Tsuzuki, Greenville, S.C.

[73] Assignee: TNS Mills, Inc., Greenville, S.C.

[21] Appl. No.: 627,921

[22] Filed: Apr. 3, 1996

Related U.S. Application Data

[63] Continuation of Ser. No. 370,627, Jan. 10, 1996, abandoned.

[51] Int. Cl.[6] ..... B65B 43/26

[52] U.S. Cl. ..... 53/459; 53/473; 53/390; 53/202; 53/525

[58] Field of Search ..... 53/390, 202, 459, 53/473, 171, 525, 54, 449

[56] References Cited

U.S. PATENT DOCUMENTS

| | | | |
|---|---|---|---|
| 1,585,950 | 5/1926 | Varney . | |
| 2,019,438 | 10/1935 | Smith | 226/129 |
| 2,661,887 | 12/1953 | Yalick et al. | 226/129 |
| 3,146,567 | 9/1964 | Filipek | 53/390 |
| 3,161,004 | 12/1964 | Muzinich | 53/391 |
| 3,570,215 | 3/1971 | Palmer et al. | 53/201 |
| 3,673,767 | 7/1972 | Hutchinson | 53/385 |
| 3,678,652 | 7/1972 | Panasewicz | 53/385 |
| 3,884,014 | 5/1975 | Ishida et al. | 53/171 |
| 3,940,908 | 3/1976 | Dazen et al. | 53/525 |
| 4,081,096 | 3/1978 | Kupcikevicius | 53/473 |
| 4,287,703 | 9/1981 | Henle et al. | 53/449 |
| 4,676,050 | 6/1987 | Odenthal | 53/171 |
| 4,907,701 | 3/1990 | Kobayashi et al. | 198/774 |
| 4,924,999 | 5/1990 | Kikuchi et al. | 198/409 |
| 4,979,353 | 12/1990 | Seppala | 53/449 |
| 4,989,391 | 2/1991 | Wetter | 53/202 |
| 5,033,251 | 7/1991 | Rodriguez | 53/54 |
| 5,052,167 | 10/1991 | Scharch | 53/444 |
| 5,117,614 | 6/1992 | Johnsen | 53/171 |
| 5,148,653 | 9/1992 | Scharch | 53/444 |
| 5,289,983 | 3/1994 | Ueda et al. | 242/35.5 |
| 5,292,081 | 3/1994 | Langen et al. | 242/35.5 |
| 5,406,770 | 4/1995 | Fikacek | 53/54 |

FOREIGN PATENT DOCUMENTS

N. 431144 2/1948 Italy .

*Primary Examiner*—John Sipos
*Assistant Examiner*—Gene L. Kim
*Attorney, Agent, or Firm*—Hardaway Law Firm, P.A.

[57] ABSTRACT

Described is a yarn packaging station and method. Yarn spools are fed to an inclined table where they slide down into a predetermined configuration. A moveable yarn bagging station is adjacent the inclined table and between the inclined table and a boxing station. The apparatus and method are designed such that a yarn spool can be bagged and boxed in one fluid movement of the human operator's arm.

25 Claims, 6 Drawing Sheets

YARN SPOOL APPARATUS AND METHOD

BACKGROUND OF THE INVENTION

This application is a continuation of application Ser. No. 08/370,627, filed Jan. 10, 1996 now abandoned.

Checking yarn for defects before packaging is an important part of the yarn processing process. While automated packaging has been implemented in, for example, U.S. Pat. Nos. 4,924,999 and 5,289,983, not all applications are adaptable to automated operation, such as those involving temporary set-ups, or lacking the space needed for the automated equipment. Accordingly, in some applications, manual unloading and packaging is still done. However, this manual unloading and packaging, which may include inspecting yarn packages, placing them in bags, and then boxing them, has been a labor intensive operation. Furthermore, the palletizing and subsequent boxing of the spools, such as shown in U.S. Pat. No. 5,292,081, or batched operations, often slows down the process and does not contemplate individually bagging each spool in its own protective package. Finally, Italian Publication No. 431,144 also shows an inefficient batch operation lacking the ability to easily and separately bag each individual yarn spool.

Thus, there is ample room for improvement within the art.

SUMMARY OF THE INVENTION

It is an object of the invention to provide a yarn packaging station and method for use when automated yarn packaging is not desirable.

It is a further object of the invention to provide a yarn packaging station and method that allows a human operator to check each yarn spool for defects prior to packaging.

It is a further object of the invention to provide a yarn packaging station and method that allows for the separate and individual bagging of yarn spools.

It is a further object of the invention to provide a yarn packaging station and apparatus that allows for the continuous and non-batch delivery of yarn spools to the device.

It is a further object of the invention to provide a yarn packaging station and method that allows the packaging to be done in a swift and efficient manner by the human operator.

These and other objects of the invention are achieved by a yarn packaging station and method comprising: a yarn staging station; a yarn boxing station spaced from the yarn staging station; and a movable yarn bagging station located between the yarn staging station and the yarn boxing station.

BRIEF DESCRIPTION

Figure 4A:
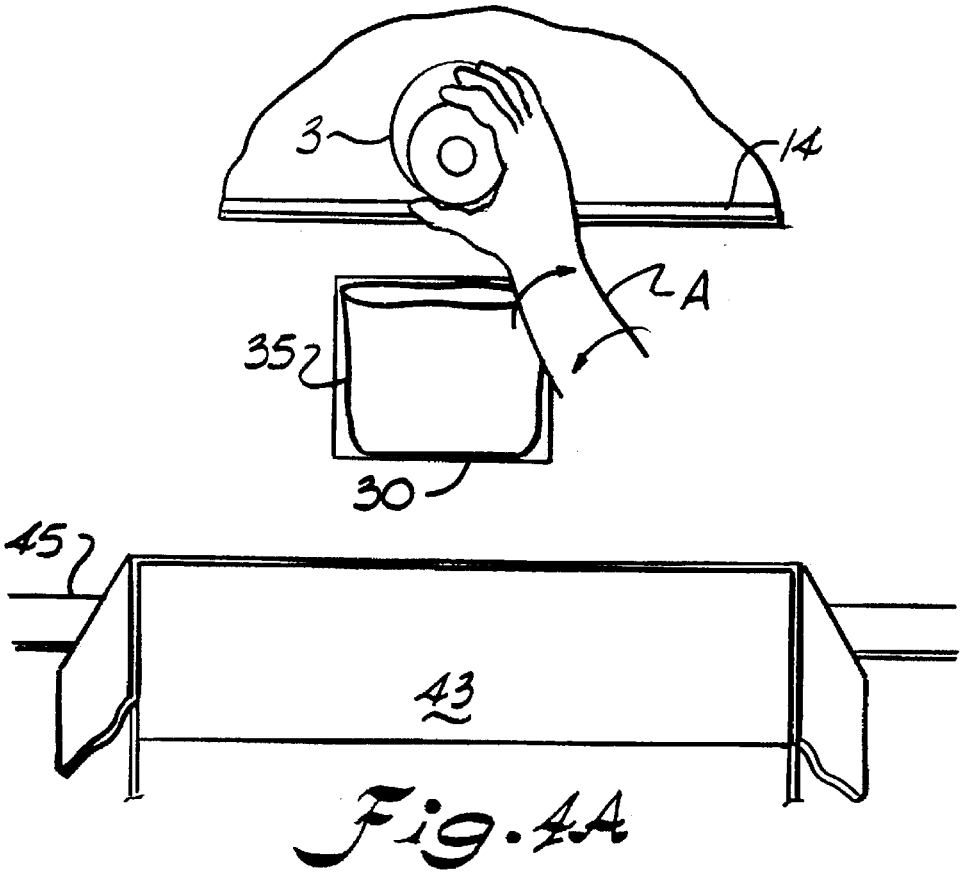
Figure 4B:
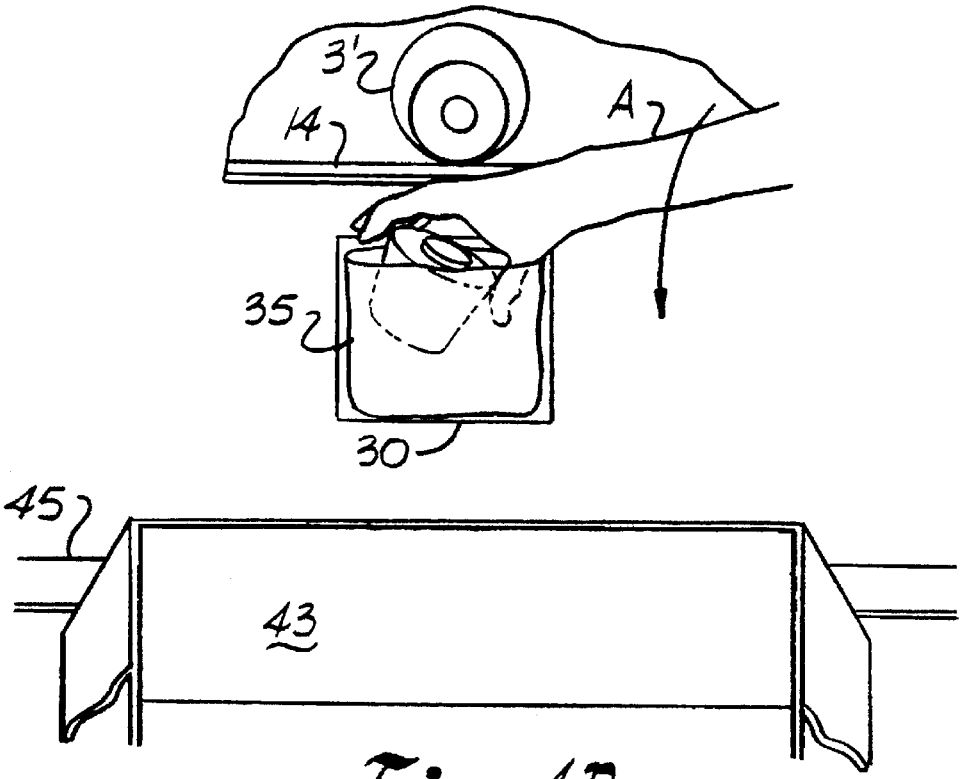
Figure 4C:
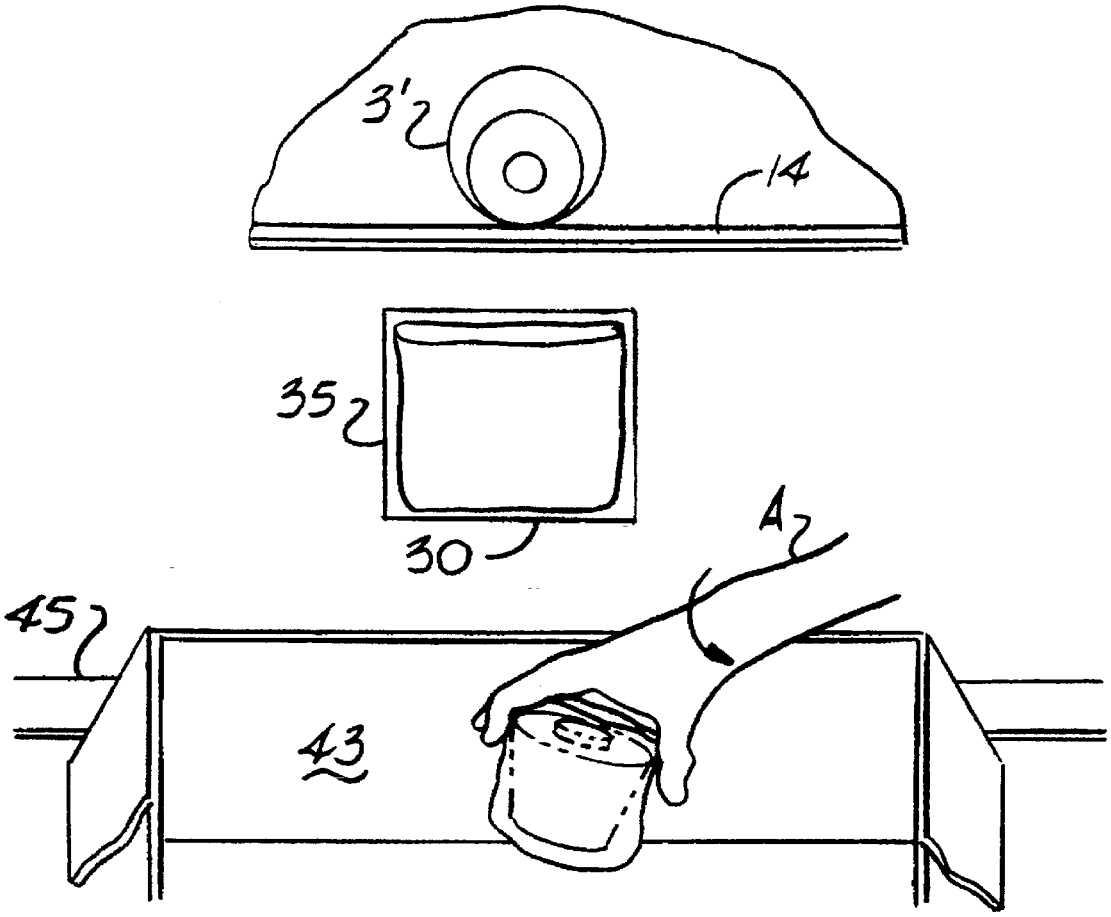

FIGS. 4A–C are perspective views showing how the bagging and boxing operation may be done in one fluid stroke of a human's arm.

Figure 5A:
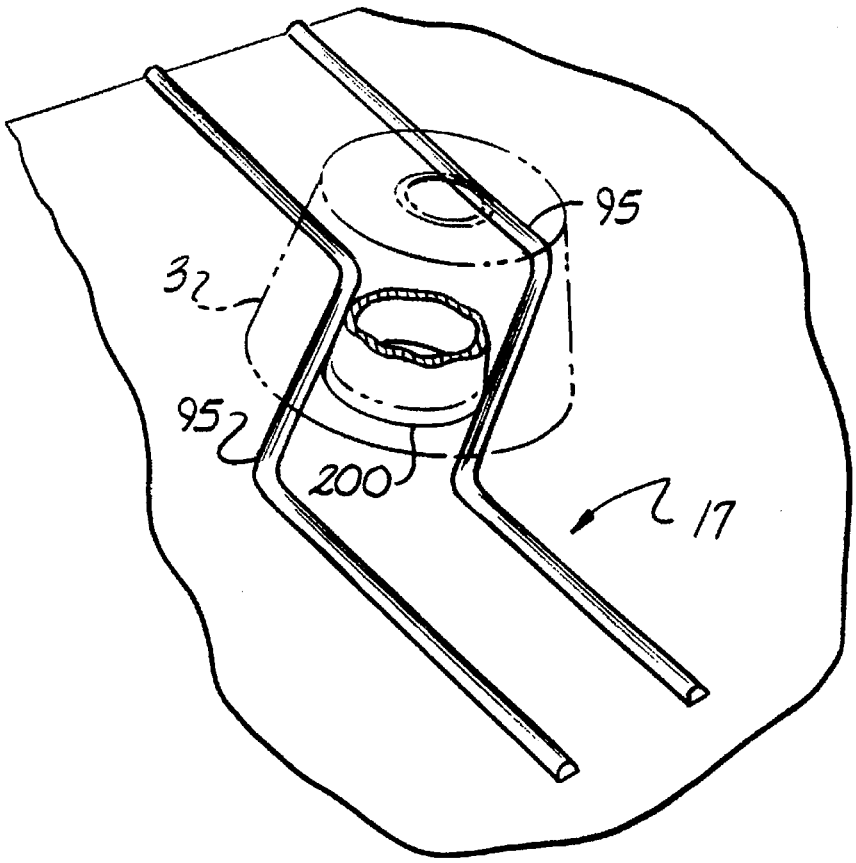
Figure 5B:
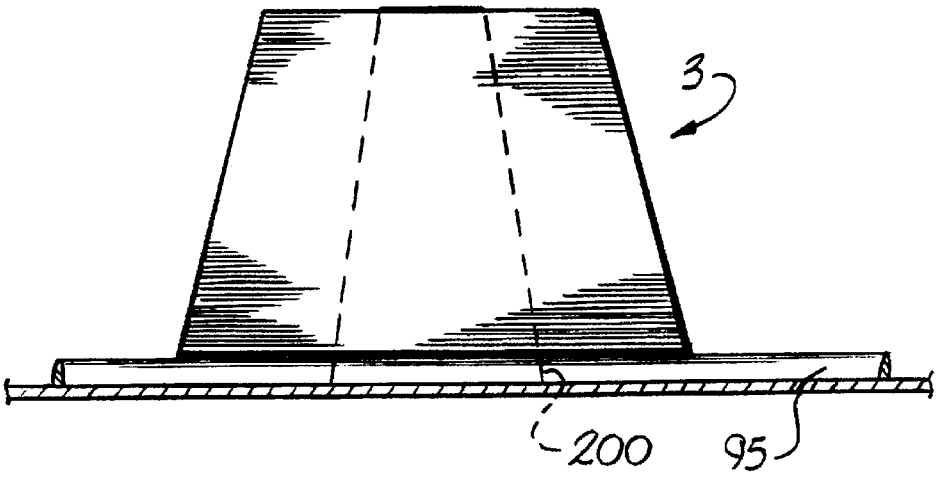

FIGS. 5A and 5B show perspective and elevational views respectively of a spool guide used in the invention.

DETAILED DESCRIPTION

Figure 1:
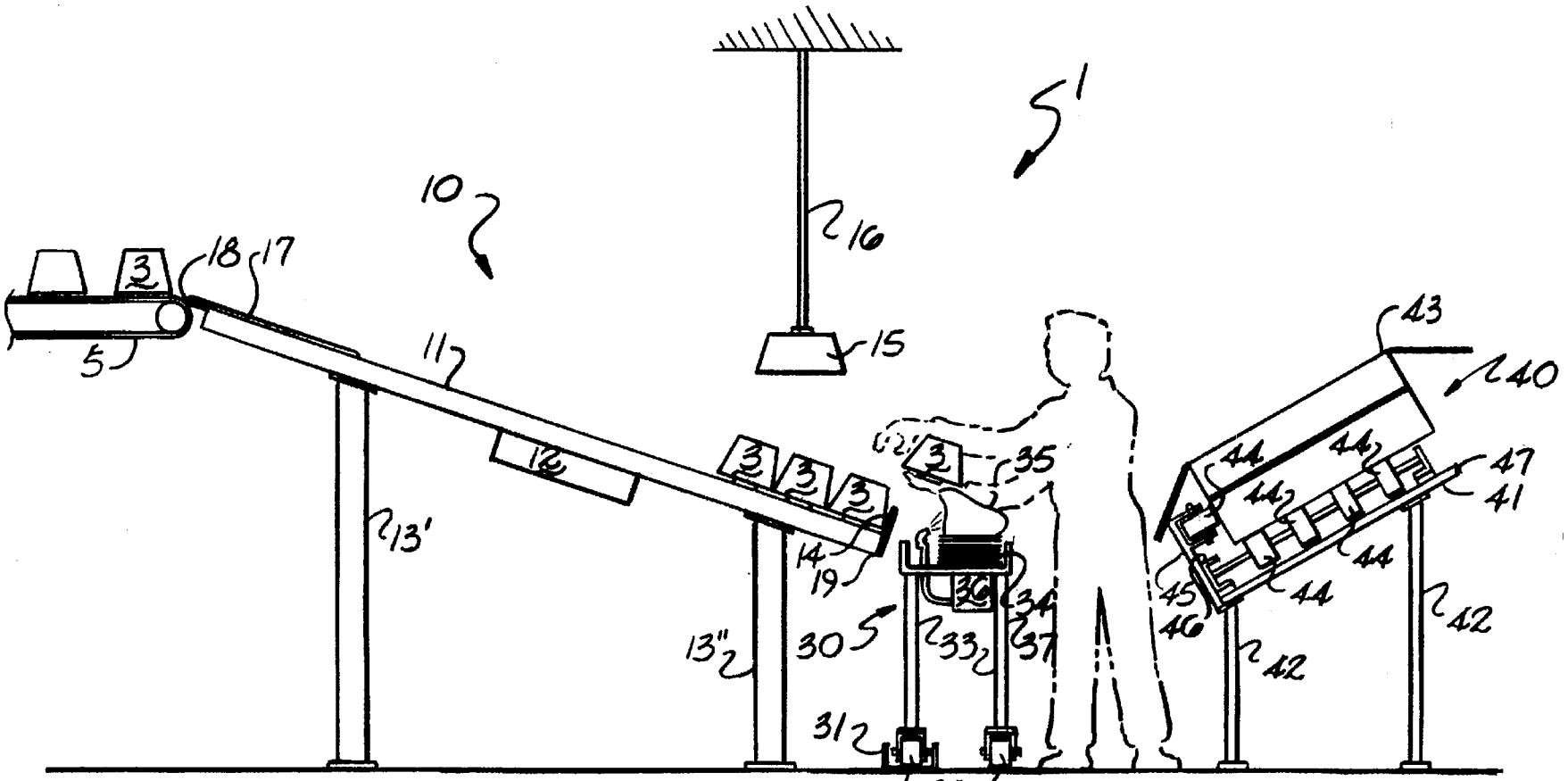
FIG. 1 is a side view of a yarn packaging station according to the invention.

FIG. 1 shows yarn packaging station 1. This station will typically be found after either a yarn spooling station or a yarn spool conditioning station. In any event, spools of yarn 3 are fed by conveyor 5 from either of those stations to yarn packaging station 1. Yarn packaging station 1 comprises: yarn staging station 10, yarn bagging station 30, and yarn boxing station 40. Yarn bagging station 30 is placed between yarn staging station 10 and yarn boxing station 40, where there is also space for a human operator to stand and use the yarn packaging station 1.

Yarn staging station 10 comprises inclined table 11 supported by legs 13', 13". While various manners of using inclined tables per se are known, e.g., U.S. Pat. Nos. 2,661,887; 3,570,215; and 2,019,438, none of these devices provide for the unique, efficient, and swift manner of bagging and packaging yarn spools that will be described herein. Inclined table 11 may have a trapezoidal shape (FIG. 2) and is preferably made from a material having a low coefficient of friction, such as polished and/or waxed wood.

Upper end 18 of inclined table 11 is adjacent conveyor 5. Conveyor 5 feeds yarn spools 3 side by side to upper end 18 of inclined table 11. Upper end 18 has spool guides 17 for receiving yarn spools 3 from conveyor 5 and directing them towards opposite halves of the inclined table 11. Spool guides 17 are made from an extremely smooth and low friction material such as TEFLON. As shown in FIG. 5A, spool guides 17 have raised edges 95 that keep cores 200 of yarn spools 3 (shown in phantom) within guide 17 and thus cause them to move along a specific path. As shown in FIG. 5B, the bottom of yarn spool 3 rests very close to the top of raised edges 95 so that yarn spool 3 will not capsize. Furthermore, since the edges 95 are typically made from the same extremely smooth material as the rest of spool guide 17, should the bottom of a yarn spool contact edge 95, no damage will be inflicted on the yarn spool.

Figure 2:
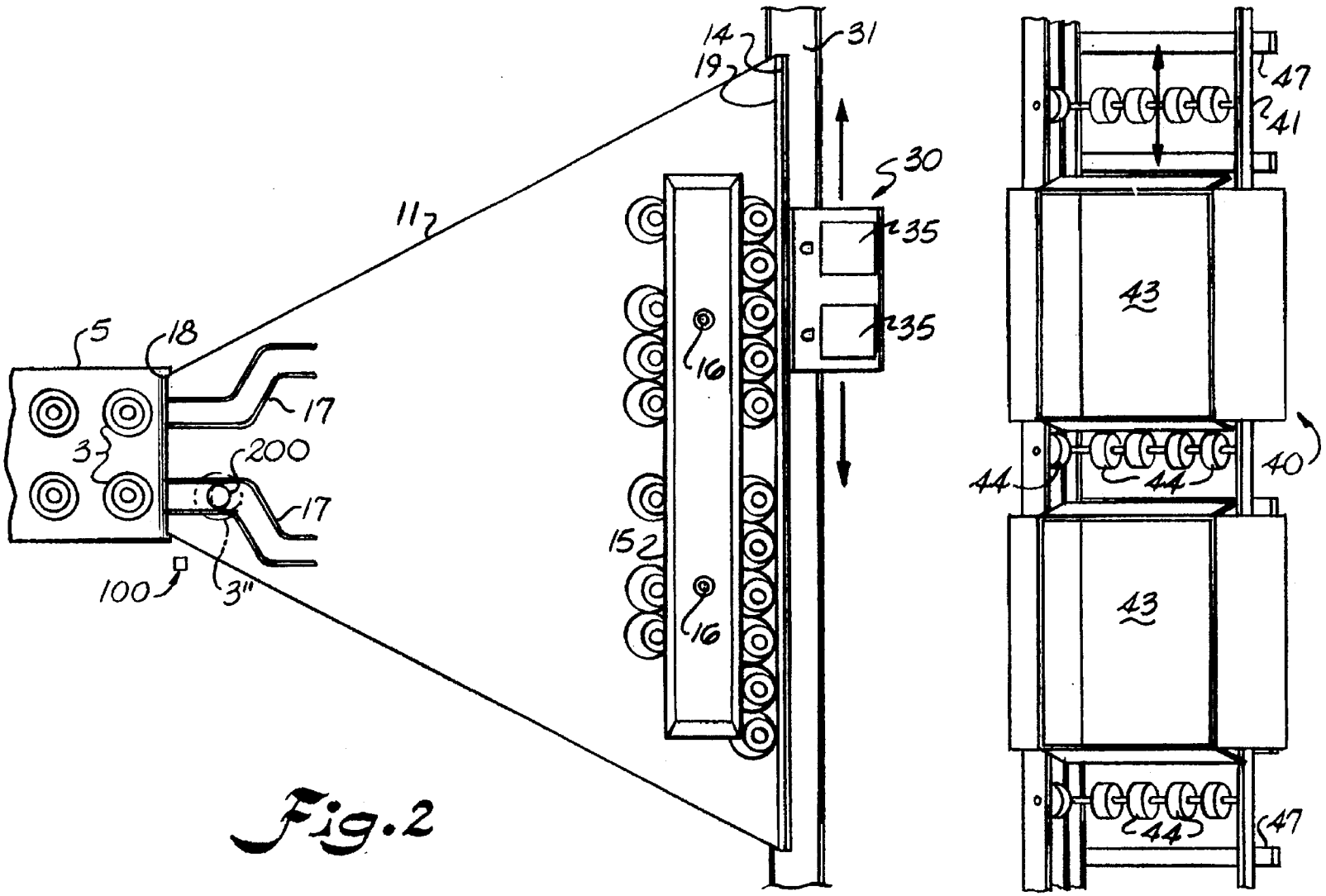
FIG. 2 is a plan view of the yarn packaging station according to FIG. 1.

Referring to FIG. 2, adjacent upper end 18 are conventional proximity sensors 100, which can be used to stop conveyor 5 in the event that an extensive backlog of yarn spools 3 on inclined table 11 is detected.

Lower end 14 of inclined table 11 has table rim 19 attached thereto. Yarn spools 3 rest on rim 14 and therefore cannot fall off of inclined table 11.

Interconnected with inclined table 11 in some manner is a vibrator 12 (FIG. 1). Vibrator 12 causes inclined table 11 to vibrate, assisting any yarn spools thereon in moving towards table rim 14. Prior art vibrating tables, such as those found in U.S. Pat. Nos. 5,052,167 and 5,148,653, are distinguished from the vibrating table according to the invention because, among other things, they do not allow for continuous feeding, sorting, or bagging, prior to boxing. Furthermore, in these patents, the vibrator is usually shut off while the actual boxing process is carried out.

Typically, above inclined table 11 will be yarn analyzer 15. Yarn analyzer 15 can be, for example, supported from the ceiling by light supports 16. Furthermore, yarn analyzer 15 will typically be a black (ultra-violet) light emitter. This light, when directed on yarn spools 3 tells the human operator which yarn spools 3 are defective by causing certain surface irregularities to be highlighted or enhanced.

As described above, yarn bagging station 30 is positioned between yarn staging station 10 and yarn boxing station 40. On the floor of the site is track 31. Track 31 runs parallel to table rim 14 and confines cart 37 to a specific translational motion parallel to table rim 14. Cart 37 comprises (FIG. 1) platform 34 supported by legs 33 on casters 32. Two side-by-side stacks of plastic bags 35 rest on platform 34. This arrangement is preferred so that the human operator may, simultaneously, bag one spool with each hand, thus bagging two spools at a time. Also associated with cart 34 is an automatic bag opening device in the form of, for example, a source of pressurized fluid, such as a tank of compressed air 36 or, as shown in U.S. Pat. Nos. 3,673,767 and 3,678,652, a powered fan device.

Boxing station 40 comprises rollerway 41 supported by supports 42 in an inclined manner. Similar to yarn staging station 10, yarn boxing station has a rim 45 at a lower end 46 of rollerway 41. Both rim portion 45, as well as the main portion of this rollerway 41, have a series of rollers 44 thereon. Rollers 41 allow for boxes 43 positioned thereon to be moved from one place to another as they go from empty to filled. Rollerway 41 is inclined to provide for a more ergonomic positioning of the boxes while simultaneously keeping the packed spools in their proper boxed configuration due to gravity. While, in general, it has been known to tilt boxes while loading, e.g., U.S. Pat. No. 3,146,567, in the device there disclosed, the tilted box is not fixed in the tilted position and can, by the resistance caused by the weight, tilt into the upright position where it is hard to load or may catch the operator's finger, causing injury thereto. Furthermore, among other distinctions, tilted boxes have never been used to keep yarn spools in their proper configuration while being boxed.

Figure 3:
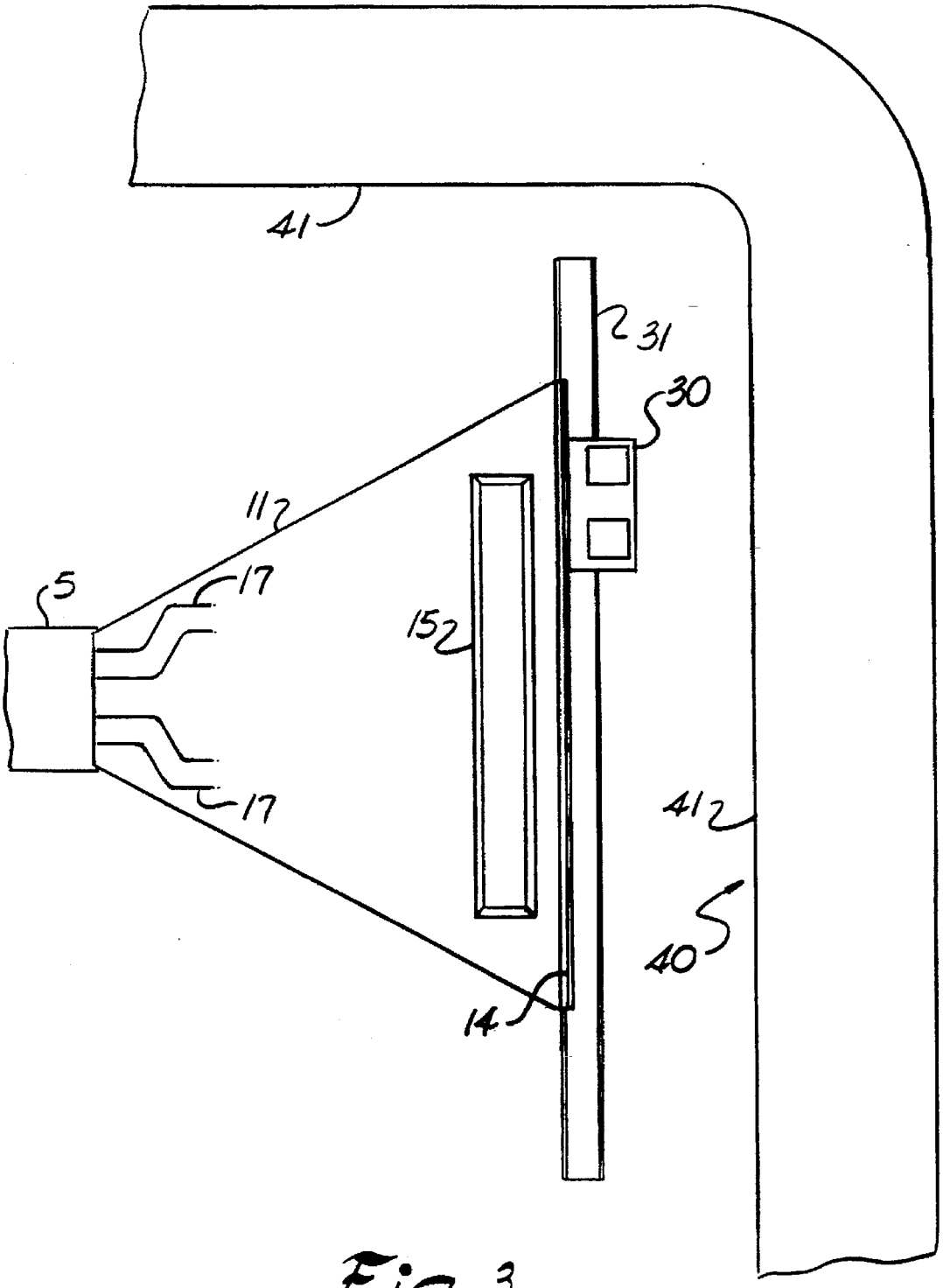
FIG. 3 is a simplified plan view of the yarn packaging station according to FIG. 1 and showing an increased capacity boxing station.

In FIG. 3 a plan view of an increased capacity yarn packaging station is shown. In that embodiment, rollerway 41 curves around inclined table 11 to make maximum use of available floor space.

Having described the yarn packaging device according to the invention, its method of use will now be described. As shown in FIG. 2 and described above, yarn spools 3 are fed side-by-side by conveyor 5 to the upper end 18 of inclined table 11. At that point they are moved onto spool guides 17 which direct yarn spools 3 to the left and right. In FIG. 2, spool 3" is shown in phantom and its core 200 shown in solid. Core 200 slides in the track formed by spool guide 17 as previously described with regard to FIG. 5A. Spool 3'"then slides down vibrating inclined table 11 until it either reaches rim 14 at lower end 19 of inclined table 11 or it is stopped by the bight formed by two adjacent and already positioned yarn spools. This process continues and two side-by-side generally triangular configurations of yarn spools 3 are created.

As for the unloading of inclined table 11, in FIG. 4A (it is assumed that the bagging station has been rolled into place adjacent the particular box 43 which is to be packed), the human operator moves his hand A over a yarn spool 3 resting on table rim 14 (all the other yarn spools 3 have been omitted for clarity). It should be noted that while only one yarn spool is removed at a time in this description, as described above, it is conceived that two yarn spools will be removed at a time; one in each hand of the human operator. The human operator grabs the top of a nondefective spool 3 and lifts it up. While yarn spool 3 is being picked up, top bag 35, which will receive yarn spool 3, is automatically opened by the bag opening device (not shown in FIG. 4A). In FIG. 4B, it can be seen that the vibrating inclined table 11 has caused a new yarn spool 3' to take the place of the yarn spool 3 that was just removed. Meanwhile, the human operator rotates his arm such that the smaller end of yarn spool 3 is in alignment with the bag opening and then swings his arm towards the bag opening until the smaller end of the yarn spool actually starts to enter open bag 35. Finally, in FIG. 4C, the operator continues to swing his arm, in one fluid motion, until the now-bagged yarn spool is over a tilted box 43 resting on rim 45. At this point, the operator will neatly place the bagged yarn spool in the box 43 where the bagged yarn spool will be kept in its proper position by the effects of gravity and the incline. Meanwhile, the next bag 35 is opened by the bag opening device (not shown in FIG. 4C) and the process then repeated.

The above description is given in reference to a yarn packaging station and method. However, it is understood that many variations are apparent to one of ordinary skill in the art from a reading of the above specification and such variations are within the spirit and scope of the instant invention as defined by the following appended claims.

That which is claimed:

1. A yarn spool packaging station, comprising:

a yarn staging station having multiple yarn spool staging locations;

a yarn boxing station spaced apart from said yarn staging station and having multiple yarn boxing locations extending along a longitudinal direction; and a translatably movable yarn bagging station for supporting preformed bags located between said yarn staging station and said yarn boxing station, said yarn bagging station translatably movable in a direction parallel to said longitudinal direction of said yarn boxing station in the area immediately adjacent said yarn staging station;

wherein by translatably moving said yarn bagging station, the yarn spool staging location from which yarn spools may be selected from said staging station and boxed at said boxing station can be varied.

2. The yarn packaging station according to claim 1, wherein said yarn staging station comprises:

an inclined table, said inclined table having upper and lower ends; and a rim at said lower end of said inclined table.

3. The yarn packaging station according to claim 2, wherein said inclined table further comprises a vibrator attached to said inclined table.

4. The yarn packaging station according to claim 3, wherein said table is made of a material having a very low coefficient of friction.

5. The yarn packaging station according to claim 4, wherein said material comprises waxed or polished wood.

6. The yarn packaging station according to claim 2, further comprising a yarn analyzing device positioned over said inclined table.

7. The yarn packaging device according to claim 6, wherein said yarn analyzing device comprises a black light emitter.

8. The yarn packaging device according to claim 2, further comprising a conveyor adjacent said top end of said inclined table for feeding yarn spools to said yarn packaging station.

9. The yarn packaging device according to claim 8, further comprising at least one TEFLON track positioned on said top end of said inclined table adjacent said conveyor.

10. The yarn packaging station according to claim 9, wherein said at least one TEFLON track comprises two TEFLON tracks positioned adjacent each other.

11. The yarn packaging station according to claim 1, further comprising a track positioned on a floor of the yarn packaging station between said yarn staging and boxing stations and said movable yarn bagging station being movable along said track.

12. The yarn packaging station according to claim 11, wherein said yarn bagging station comprises:

a plurality of casters, at least two of said casters being positioned in said track;

a leg extending out of each caster;

a platform supported on said legs;

at least one stack of bags supported on said platform; and a bag opener supported by said platform.

13. The yarn packaging station according to claim 12, wherein said bag opener comprises a source of pressurized air.

14. The yarn packaging station according to claim 12, wherein said at least one stack of bags comprises two side-by-side stacks of bags.

15. The yarn packaging station according to claim 1, wherein said yarn boxing station comprises:

an inclined rollerway, said inclined rollerway having a rim at its lower end;

said inclined rollerway having the ability to support a plurality of boxes for holding bagged spools of yarn.

16. A method of packaging yarn spools, comprising the steps of:

providing a staging station, a translatably movable bagging station for supporting preformed bags, and a boxing station;

providing said boxing station extending along a longitudinal direction with a supply of boxes;

feeding yarn spools to said staging station;

letting said yarn spools at said staging station form a predetermined configuration having multiple locations from which yarn spools may be removed from;

moving said bagging station in a direction parallel to said longitudinal direction of said yarn boxing station in the area immediately adjacent said yarn staging station and until said bagging station is adjacent one of said multiple locations of said predetermined configuration;

automatically opening at least one bag provided at said bagging station;

removing at least one yarn spool from said one of said multiple locations of said predetermined configuration formed on said staging station;

placing said at least one yarn spool in said automatically opened bag to obtain a bagged spool, removing said bagged spool from said bagging station, causing another bag to be automatically opened; and placing said bagged spool in one of the boxes in said supply of boxes.

17. The process according to claim 16, wherein said steps of placing said at least one spool in automatically opened bag, removing said bagged spool from said bagging station, causing another bag to be automatically opened, and placing said bagged spool in one of the boxes in said supply of boxes can be done in one fluid motion of an arm.

18. The process according to claim 16, wherein said step of providing a staging station comprises:

providing an inclined table having upper and lower ends and a rim at said lower end of said inclined table.

19. The process according to claim 17, further comprising the step of causing said inclined table to vibrate.

20. The process according to claim 16, wherein:

said step of removing at least one yarn spool comprises removing one yarn spool with each hand;

said step of automatically opening at least one bag comprises automatically opening two bags;

said step of placing said at least one spool comprises placing each of said two spools in one of said two automatically opened bags;

said step of removing said bagged spool comprises removing two bagged spools from said bagging station, causing another two bags to be automatically opened; and said step of placing said bagged spool comprises placing said two bagged spools in one of the boxes in said supply of boxes.

21. The process according to claim 16, wherein said step of feeding yarn spools comprises feeding a series of side-by-side yarn spools along a conveyor and said step of letting said yarn spools form a predetermined configuration comprises letting said yarn spools form two side-by-side generally triangular configurations.

22. The process according to claim 16, wherein said predetermined configuration comprises a generally triangular configuration.

23. The process according to claim 16, wherein after said at least one yarn spool is removed from its position in said predetermined configuration, another yarn spool is moved to occupy said position.

24. The yarn packaging station according to claim 1, wherein the entire yarn bagging station is translatably movable in said direction parallel to said yarn boxing station.

25. The method according to claim 16, wherein:

said step of providing a translatably movable yarn bagging station comprises providing an entirely translatably movable yarn bagging station; and said step of moving said bagging station in a direction parallel to said yarn boxing station comprises moving the entire said bagging station in said direction parallel to said yarn boxing station.

* * * * *